United States Patent [19]

Ohishi et al.

[11] Patent Number: 4,743,878

[45] Date of Patent: May 10, 1988

[54] CIRCUIT INTERRUPTER

[75] Inventors: Hirotoshi Ohishi; Hiroshi Fujii; Hiroaki Fujihisa; Yoshiaki Kobayashi; Kiyoshi Matsuura, all of Fukuyama, Japan

[73] Assignee: Mitsubishi Denki Kabushiki Kaisha, Japan

[21] Appl. No.: 857,092

[22] Filed: Apr. 29, 1986

[30] Foreign Application Priority Data

May 1, 1985 [JP] Japan ..... 60-64257[U]
May 1, 1985 [JP] Japan ..... 60-64258[U]

[51] Int. Cl.[4] ..... H01H 9/00

[52] U.S. Cl. ..... 335/172; 335/174; 335/176

[58] Field of Search ..... 335/172, 174, 175, 176, 335/168; 200/153 G

[56] References Cited

U.S. PATENT DOCUMENTS

| | | | |
|---|---|---|---|
| 4,197,519 | 4/1980 | Grenier | 335/175 |
| 4,608,546 | 8/1986 | Westermeyer | 335/175 |
| 4,609,799 | 9/1986 | Ohishi et al. | 200/153 G |

FOREIGN PATENT DOCUMENTS

| | | |
|---|---|---|
| 0091040 | 3/1983 | European Pat. Off. . |
| 684311 | 12/1952 | United Kingdom . |
| 1185211 | 3/1970 | United Kingdom . |
| 1211523 | 11/1970 | United Kingdom . |
| 1355035 | 5/1974 | United Kingdom . |
| 1450184 | 9/1976 | United Kingdom . |
| 2107932 | 5/1983 | United Kingdom . |

*Primary Examiner*—E. A. Goldberg
*Assistant Examiner*—Lincoln Donovan
*Attorney, Agent, or Firm*—Leydig, Voit & Mayer

[57] ABSTRACT

In a circuit interrupter having a base with a stationary contact, a toggle link mechanism including an operating handle supported by the base for manually operating the circuit interrupter and a link rotatably connected at one end to the operating handle; a movable member pivotally supported on the base and having a movable contact on one pivoting end portion; a latch lever pivotally supported on the base for latching the link so that the movable member and the link are normally connected to hold the movable member against the force of a biasing spring so that the contacts are in engagement, and an overcurrent trip means including a plunger actuated responsive to a large overcurrent to strike and pivot the latch lever so as to release the link from the movable member to move and separate the contacts, the improvement comprising a pivotal support for the latch lever and the movable member on the base, allowing both bodily movement and pivotal movement only of the movable member; the pivotal support including a pin fixed to the base extending through a circular hole in the latch lever and through a hole in the movable member which is elongated to allow bodily movement thereof without separating the contacts, and pivotal movement thereof separating the contacts by the biasing spring after a delay determined by the length of the elongated hole upon pivotal movement of the latch lever by the plunger striking the latch lever responsive to large overcurrent, releasing the link from the movable member, whereby any impact force due to the plunger striking the latch lever is transmitted to the base through the pin.

4 Claims, 6 Drawing Sheets

CIRCUIT INTERRUPTER

BACKGROUND OF THE INVENTION

This invention relates to a circuit interrupter, and more particularly to a circuit interrupter which comprises a toggle link mechanism composed of an operating handle and a link, a latch lever for engaging and releasing a movable member and the link, and an overcurrent trip means.

A conventional circuit interrupter of this kind is constructed as shown in FIGS. 1 and 2. FIG. 1 is a sectional side view illustrating the OFF state of the conventional circuit interrupter and FIG. 2 is an exploded perspective view showing the main portion of the circuit interrupter. In the figures, 1 is a base made of an electrically insulating material, 2 is a handle pivotally supported around a shaft 101 which is a portion of the base 1, 3 is a torsion spring mounted on the shaft 101, its one end engaging said base 1 and the other end engaging the handle 2 to bias the handle 2 in the counterclockwise direction.

A U-shaped pin 4 which is a link having one leg rotatably inserted into a hole (not shown) formed in the inner end 201 of the handle 2, 5 is a movable member pivotally supported by a shaft 6 supported by an elongated hole 102 formed in the base 1, the movable member having a pair of first and second latch surfaces 5*a* and 5*b* at one of the pivot end portions. A latch lever 7 pivotally supported by the shaft 6 and is usually biased by a torsion spring 8 in the direction opposite to the direction in which the movable member 5 is biased and has a latch portion 7*a* for usually holding the other end of the link 4 together with the latch surfaces 5*a* and 5*b*.

A shaft 11 is mounted on the movable member 5, a movable contact 12 is secured at one end of the movable member 5, a shaft 13 is mounted on the base 1, a tension spring 14 is disposed between the shaft 13 and the shaft 1, a stationary member 15 is fixed on the base 1, a stationary contact 16 is secured on the stationary member 15 opposite to the movable contact 12, a coil 17 has one end which is electrically connected to the stationary contact member 15, and a terminal 18 is electrically connected to the coil 17 for connecting thereto an external conductor (not shown) by a wire catcher 19 and a screw 20.

A yoke 21 is mounted on the base 1 for forming a magnetic path, a plunger 22 is attracted to the left in the figure against the spring force of the compression spring 23 when the coil 17 is energized, and the coil 17 is wound around a bobbin 24, through the hollow portion of which the plunger 22 loosely extends. A rod 25 is driven to the left in the figure when the plunger 22 is attracted, a flexible copper wire 26 is electrically connected at one end to the movable member 5, and the other end of the flexible copper wire 26 is electrically connected to a bimetal 27, one end of the bimetal 27 being secured to a terminal 28, for connecting an external conductor (not shown) by a wire catcher 29 and a screw 30. An adjusting screw 31 is threaded into the terminal 28, an insulating tube 32 is disposed on the bimetal 27, an arc runner 33 is secured at one end to the terminal 28 and its other end is fitted into the groove in the base 1, side plates 34 are disposed in parallel to the moving direction of the arc on both sides of the arc runner 33, an arc extinguishing chamber 35 is for extinguishing an arc generated between the movable contact 12 and the stationary contact 16 and in which a plurality of grids 36 are supported at predetermined intervals by a pair of side plates 37.

As apparent from the foregoing description, when the circuit interrupter is in either an OFF state as shown in FIG. 1 or an ON state as shown in FIG. 3, the link 4 is held by the latch surfaces 5*a* and 5*b* of the movable member 5 and the latching portion 7*a* of the latch lever 7. When the handle 2 of the circuit interrupter shown in FIG. 1 is turned in the righthand direction (O operation) from the OFF state, the toggle link mechanism formed by the inner end 201 of the handle 2 and the link 4 straightens passing over the dead point, thereby causing the movable member 5 to rotate counterclockwise about the shaft 6, and the movable contact 12 engages the stationary contact 16, providing the ON state shown in FIG. 3. Then, when the handle 2 is rotated in the lefthand direction (OFF operation), the toggle mechanism formed by the inner end 201 of the handle 2 and the link 4 collapses passing over the dead point to rotate the movable member 5 around the shaft 6 in the clockwise direction to separate the movable contact 12 from the stationary contact 16 bringing about the OFF state shown in FIG. 1.

Next, when a relatively small overcurrent such as an overload current flows, the bimetal 27 in the state shown in FIG. 3 deflects due to its Joule's heat to press the lever 7 by the tip portion of the bimetal 27 to release the engagement of the other end of the lever 7, to rotate the movable member 5 clockwise about the shaft 6 by the biasing force of the tension spring 14 to separate the movable contact 12 from the stationary contact 16, to a state at the instant of tripping as shown in FIG. 4. Thereafter, the biasing force of the torsion spring 3 causes the rotation of the handle 2 in the counterclockwise direction, positioning the other end of the link 4 between the latch surfaces 5*a* and 5*b* and the latching portion 7*a* to hold the link 4 by the latch surfaces 5*a* and 5*b* and the latching portion 7*a*, providing the OFF state shown in FIG. 1. That is, an automatic reset is achieved. The above-described tripping is achieved with a time delay.

On the other hand, when a large overcurrent such as a shortcircuiting current flows, the coil 17 is excited to attract the plunger 22 against the biasing force of the compression spring 23 to push out the rod 25, rotating the lever 7 in the clockwise direction about the shaft 6 to release the other end of the link 4. Thereafter, the operation is similar to the operation when an overload current achieves tripping. This tripping is achieved instantaneously.

With the conventional circuit interrupter as above described, since the latch lever 7 is mounted to the movable member 5 by a shaft 6, an impact force is directly transmitted to the movable member 5 from the rod 25 through the shaft 6 upon shortcircuiting, causing an instantaneous separation of the movable contact 12 from the stationary contact 16 to generate an electric arc therebetween and immediately reclosing, posing a problem of contact welding.

Also, since the movable member 5 electromagnetically repulses to separate together with the latch lever 7 when a shortcircuiting current increases, the time point at which the rod 25 pushes the latch lever 7 away from the movable member is delayed, resulting in a delay in tripping. That is, a problem arises which prevents quick interruption. The problem is severe at higher instantaneous trip current set values of a high current rating.

SUMMARY OF THE INVENTION

Accordingly, an object of the present invention is to provide a circuit interrupter in which the welding of the contacts does not readily occur.

Another object of the present invention is to provide a circuit interrupter in which quick interruption can be achieved.

With the above objects in view, in the circuit interrupter of the present invention, a circular hole is provided in the base so that the latch lever is supported by a shaft received in the circular hole, and an elongated hole is formed in the movable member so that the elongated hole supports the movable member on the base by means of a shaft.

According to another aspect of the present invention, the latch lever may have formed thereon a projection for rotating the latch lever in the direction of releasing the engagement of the link by the separation of the movable member due to electromagnetic repulsion.

According to the present invention, the impact force exerted on the latch lever is directly transmitted to the base through the shaft and not to the movable member.

The movable member pushes the projection of the latch lever upon the separation due to electromagnetic repulsion to rotate the latch lever in the direction for releasing the engagement of the link to achieve tripping.

BRIEF DESCRIPTION OF THE DRAWINGS

The invention will become more readily apparent from the following detailed description of the preferred embodiment of the present invention taken in conjunction with the accompanying drawings, in which:.

DESCRIPTION OF THE PREFERRED EMBODIMENTS

Figure 1:
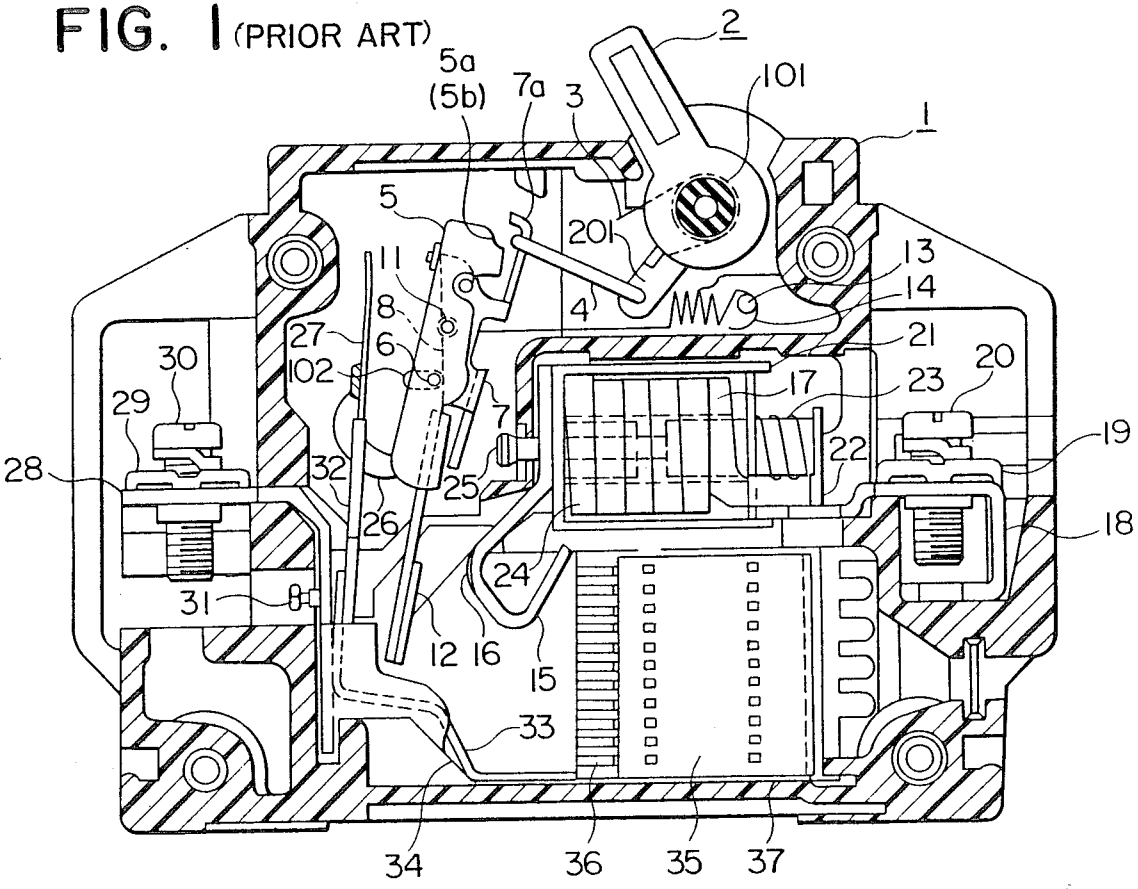
FIG. 1 (PRIOR ART)
FIG. 1 is a sectional side view showing the OFF state of a conventional circuit interrupter.
Figure 2:
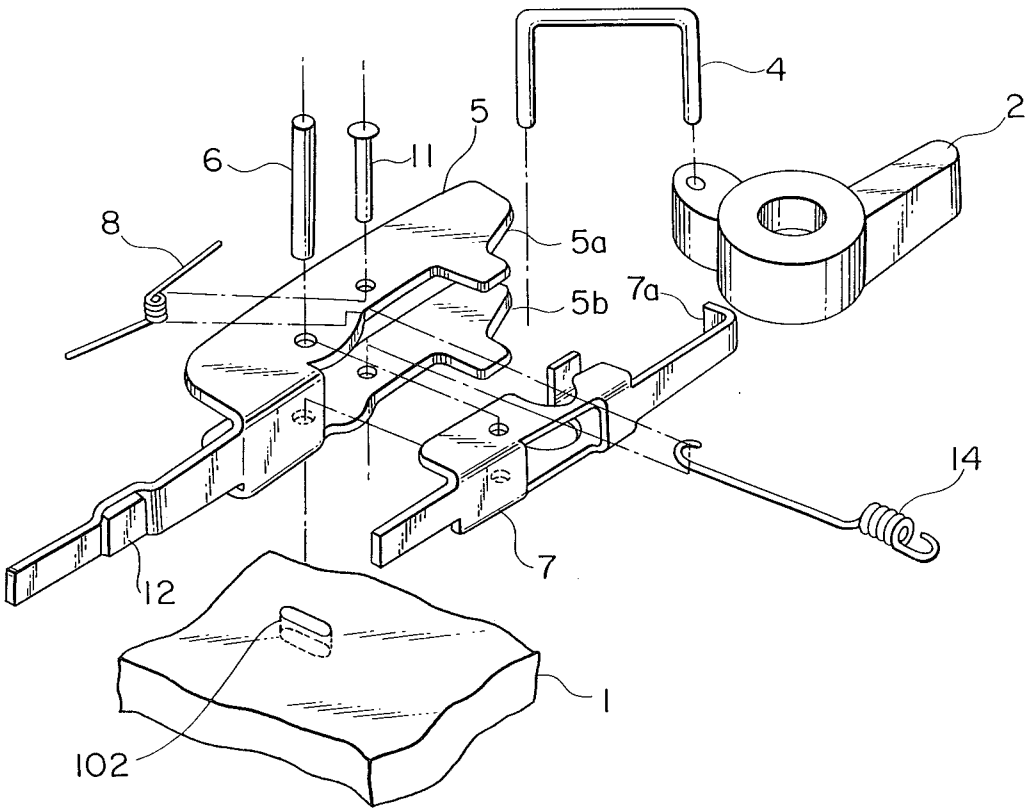
FIG. 2 PRIOR ART
FIG. 2 is an exploded perspective view illustrating the main parts of the conventional circuit interrupter shown in FIG. 1.
Figure 3:
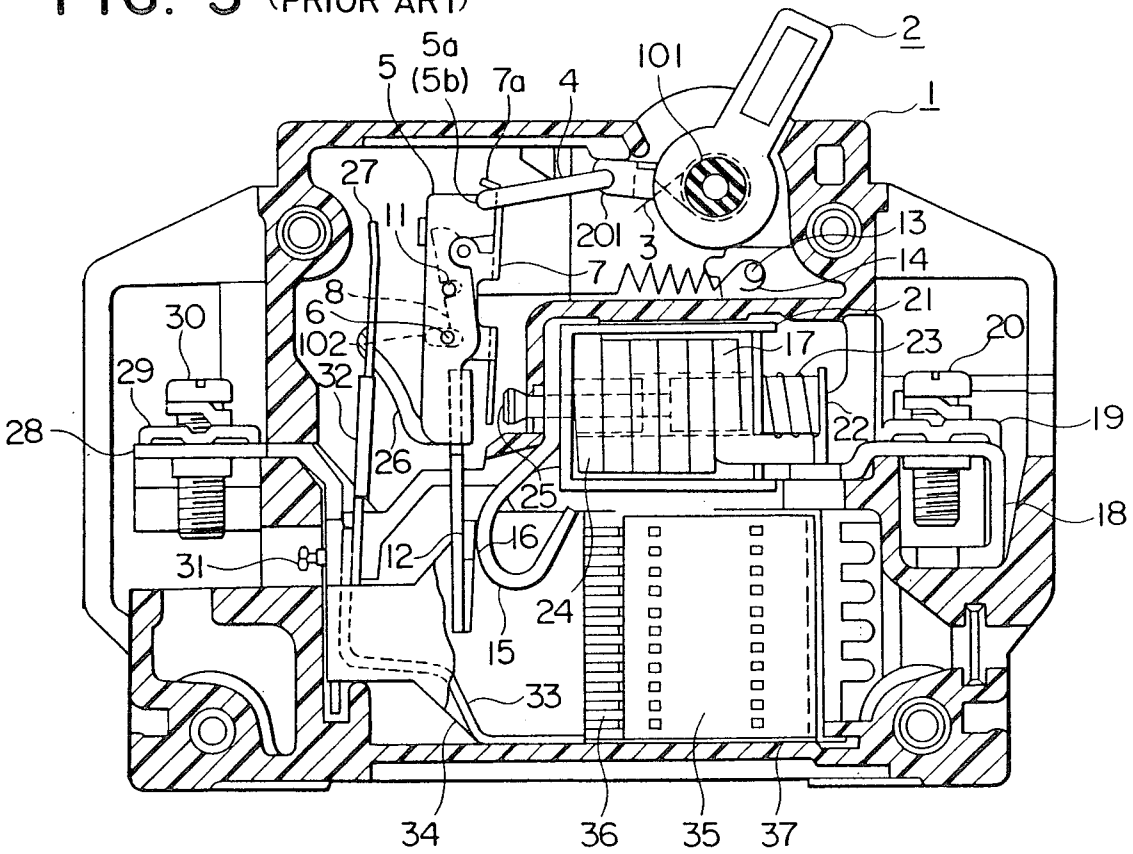
FIG. 3 (PRIOR ART)
FIG. 3 is a sectional side view showing the ON state of the interrupter shown in FIG. 1.
Figure 4:
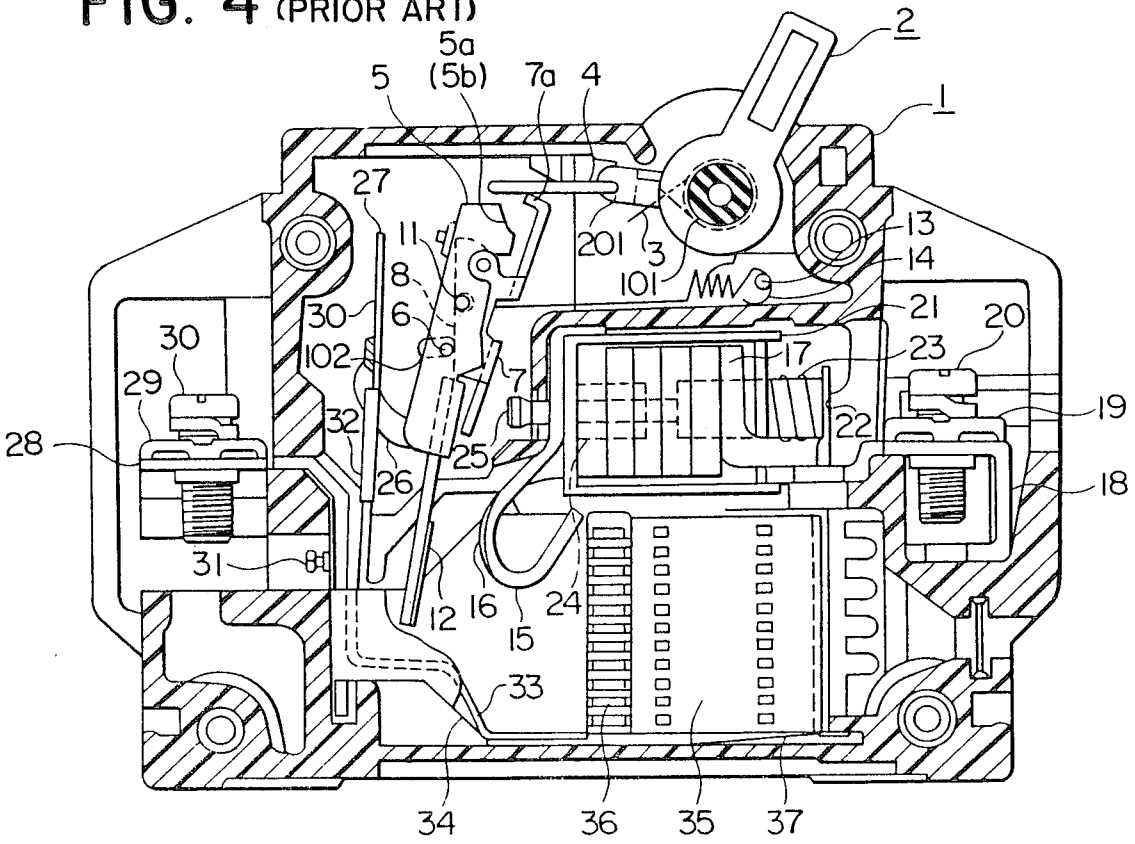
FIG. 4 (PRIOR ART)
FIG. 4 is a sectional side view for explaining the operation of the circuit interrupter.
Figure 5:
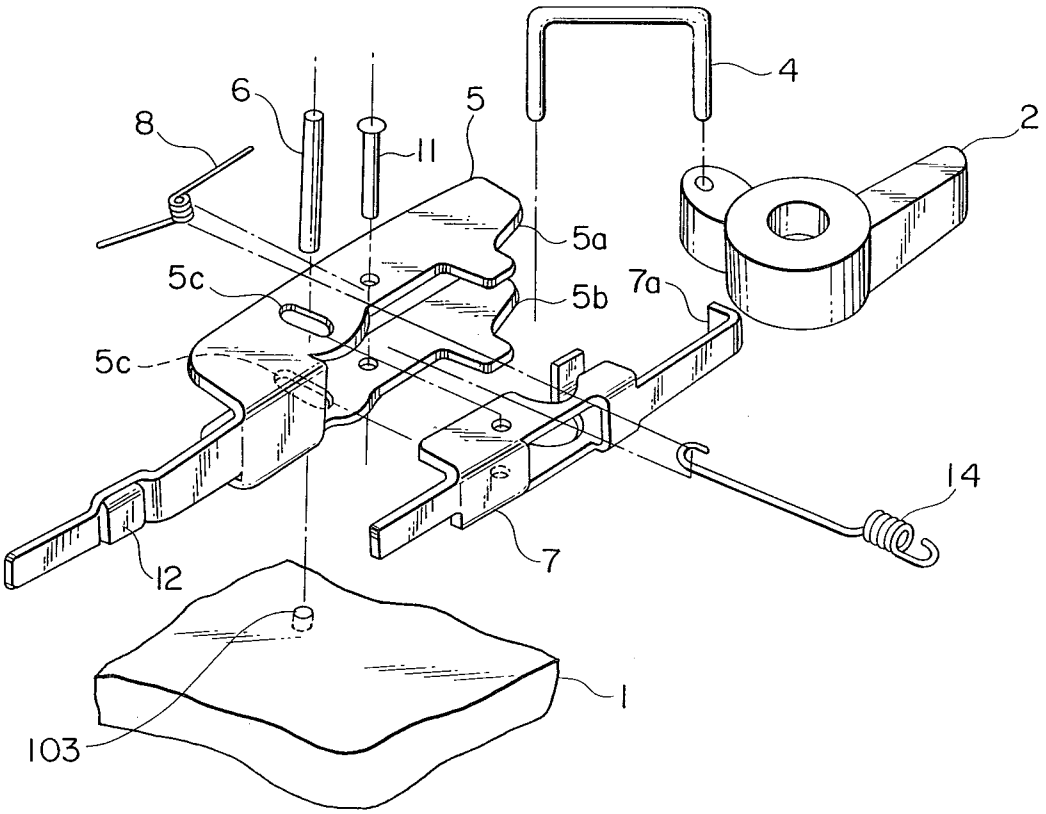
FIG. 5 is an exploded perspective view of the main portion of the circuit interrupter of the present invention.

FIG. 5 illustrates one embodiment of the present invention, in which 103 is a circular hole formed in the base 1, and 5*c* is an elongated hole formed in the movable member 5 through which the shaft 6 extends. The latch lever 7 is directly supported by the shaft 6 received within the circular hole 103 formed in the base 1.

As for remaining structure, since it is similar to the conventional structure explained above, the same reference numerals are used and the explanation s omitted herein.

With the above construction, the opening and closing operation of the contacts is similar to that of the conventional arrangement. When a large overcurrent such as a shortcircuiting current flows, the coil 17 is energized to attract the plunger 22 against the biasing force of the compression spring 23 to push out the rod 25, thereby causing the latch lever 7 to rotate clockwise as seen in the figure about the shaft 6 so that the other end of the link 4 is released. At this time, the impact force exerted on the latch lever 7 is directly transmitted to the base 1 through the shaft 6, and the force transmitted to the movable member 5 is reduced by the elongated hole 5*c* so that the contacts 12 and 16 are not separated.

Figure 6:
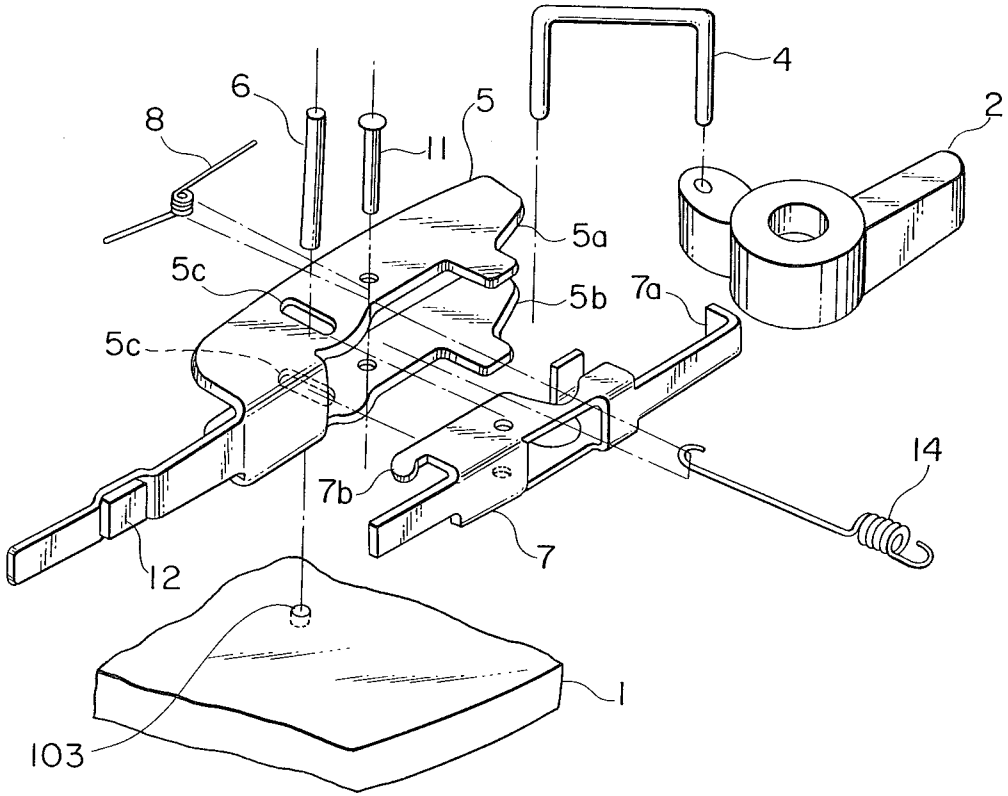
FIG. 6 is an exploded perspective view of the main portion of the circuit interrupter.

FIG. 6 illustrates another embodiment of the present invention, in which 103 is a circular hole formed in the base 1, and 5*c* is an elongated hole formed in the movable member 5 through which the shaft 6 extends. The latch lever 7 is provided with a projection 7*b* and is directly supported by the shaft 6 received within the circular hole 103 formed in the base 1.

With the above construction, the opening and closing operation of the contacts is similar to that of the conventional arrangement. When a large overcurrent such as a shortcircuiting current flows, an electromagnetic force generated between the movable contact 12 and the stationary contact 16 as well as the parallel conductor repulsive force generated between the movable member 5 and the stationary member 15 causes the movable member 5 to be separated, pushing the projection 7*b* of the latch lever 7 to rotate the latch lever 7 clockwise, thereby releasing the engagement of the link 4 to trip the interrupter. At this time, the plunger 23 is also attracted and the rod 25 is pushed out to rotate the latch lever 7 clockwise. This action is further delayed compared to the repulsion separation of the movable member 5 as the current increases.

In the above embodiments, while the housing is used as the base 1 in which the circular hole 103 is formed, a support plate for supporting the toggle link mechanism, the movable member 5 and the latch lever 7 may be used as the base and may be mounted in the housing, providing advantages similar to those obtained in the above embodiment.

As has been described, according to the present invention, since a circular hole is formed in the base and the latch lever is directly supported by the shaft in the circular hole, and an elongated hole is formed in the movable member and the movable member is supported by the base with the shaft in the elongated hole, a circuit interrupter is provided in which the contacts do not become welded . Also, since the latch lever has formed thereon a projection for rotating the latch lever in the direction for releasing the engagement of the link by the separation of the movable member due to electromagnetic repulsion, the tripping operation is quick and capable of achieving a high speed high current limiting interruption. This advantage is more significant in a higher current rating at a high instantaneous tripping current set value.

What is claimed is:

1. In a circuit interrupter having a base with a stationary contact, a toggle link mechanism including an operating handle supported by the base for manually operating the circuit interrupter and a link rotatably connected at one end to the operating handle ; a movable member pivotally supported on the base and having a movable contact on one pivoting end portion; a latch lever pivotally suported on the base for latching the link so that the movable member and the link are normally connected to hold the movable member against the force of a biasing means so that the contacts are in engagement, and an overcurrent trip means including a plunger actuated responsive to a large overcurrent to strike and pivot the latch lever so as to release the link from the movable member to move and separate the contacts, the improvement comprising:

means for pivotally supporting the latch lever and the movable member on the base, allowing both bodily movement and pivotal movement only of the movable member;

said supporting means including a pin fixed to the base extending through a circular hole in the latch lever and through a hole in the movable member which is elongated to allow bodily movement thereof without separating the contacts, and pivotal movement thereof separating the contacts by the biasing means after a delay determined by the length of the elongated hole upon pivotal movement of the latch lever by the plunger striking the latch lever responsive to large overcurrent, releasing the link from the movable member, whereby any impact force due to the plunger striking the latch lever is transmitted to the base through the pin.

2. A circuit interrupter as claimed in claim 1 wherein the latch lever includes a projection engageable by the movable member for rotating the latch lever in a direction so as to release the link upon separation of the contacts due to an electromagnetic repulsive force generated upon shortcircuiting.

3. A circuit interrupter as claimed in claim 1 wherein the base is formed in a housing for the circuit interrupter.

4. A circuit interrupter as claimed in claim 1 wherein the base comprises a support plate mounted in a housing for the circuit interrupter.

* * * * *